US007448623B2

(12) United States Patent
Ahn et al.

(10) Patent No.: US 7,448,623 B2
(45) Date of Patent: Nov. 11, 2008

(54) PAPER FEEDING MECHANISM AND IMAGE FORMING APPARATUS EMPLOYING THE SAME

(75) Inventors: Byeong-hwa Ahn, Seongnam-si (KR); Se-hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 483 days.

(21) Appl. No.: 11/097,163

(22) Filed: Apr. 4, 2005

(65) Prior Publication Data

US 2005/0280206 A1 Dec. 22, 2005

(30) Foreign Application Priority Data

Jun. 16, 2004 (KR) ..... 10-2004-0044513

(51) Int. Cl.
*B65H 5/02* (2006.01)

(52) U.S. Cl. ..... 271/273; 271/274

(58) Field of Classification Search ..... 271/273, 271/274

See application file for complete search history.

(56) References Cited

U.S. PATENT DOCUMENTS 4,958,195 A * 9/1990 Firth et al. ..... 399/332
5,146,239 A * 9/1992 Ono ..... 347/171
5,203,553 A * 4/1993 Chiang ..... 271/3.18
5,358,230 A * 10/1994 Ikemori et al. ..... 271/114
5,432,539 A * 7/1995 Anderson ..... 347/33
5,459,553 A * 10/1995 Kim ..... 399/20
6,139,010 A 10/2000 Yokoi
6,547,239 B2 * 4/2003 Takata ..... 271/274
6,817,611 B2 * 11/2004 DiRamio ..... 271/273
7,090,215 B2 * 8/2006 Mandel et al. ..... 271/273
7,270,323 B2 * 9/2007 Somemiya ..... 271/127
2003/0122913 A1 * 7/2003 Lee et al. ..... 347/104

FOREIGN PATENT DOCUMENTS

JP 08-169577 7/1996
JP 09-030670 2/1997
JP 10-250882 9/1998

* cited by examiner

*Primary Examiner*—Patrick H Mackey
*Assistant Examiner*—Luis Gonzalez
(74) *Attorney, Agent, or Firm*—Roylance, Abrams, Berdo & Goodman LLP.

(57) ABSTRACT

A paper feeding mechanism for an image forming apparatus includes a drive roller rotated by a first shaft driven by a motor. A press roller is supported by a second shaft which is parallel to and spaced apart from the first shaft. The press roller is pressed against the drive roller, and is driven by the drive roller. A cam pushes the second shaft (and therefore the press roller) away from the drive roller to prevent unnecessary external forces from being exerted on paper being fed through the rollers. The cam is actuated by clutching means for transferring rotating force of the first shaft to the cam to rotate the cam when it is necessary to move the press roller away from the drive roller.

13 Claims, 5 Drawing Sheets

PAPER FEEDING MECHANISM AND IMAGE FORMING APPARATUS EMPLOYING THE SAME

CROSS-REFERENCE TO RELATED APPLICATIONS

This application claims the benefit under 35 U.S.C. § 119 (a) of Korean Patent Application Serial No. 2004-44513, filed on Jun. 16, 2004, the entire disclosure of which is hereby incorporated by reference.

BACKGROUND OF THE INVENTION

1. Field of the Invention

The present invention relates to an image forming apparatus. More particularly, the present invention relates to a paper feeding mechanism for an image forming apparatus that includes a drive roller and a press roller which are selectively moved apart from each other to prevent unnecessary external forces from being exerted on paper being fed by the mechanism.

2. Description of the Related Art

In general, an image forming apparatus is an apparatus for printing a desired image on paper, such as a printer, a copymachine, and the like. These apparatuses include a printing mechanism for printing an image on paper and a paper feeding mechanism for feeding paper to the printing mechanism.

FIG. 1 is a perspective view showing one example of a conventional paper feeding mechanism employed in an image forming apparatus. The paper feeding mechanism includes a drive roller shaft 3 rotated by a driving force generated by a driving means (not shown), such as an electric motor. A drive roller 2 is fixed to the drive roller shaft 3, and a press roller 5 is in intimate contact with the drive roller 2 and driven by the drive roller 2. The press roller 5 is pivotably mounted to a hinge shaft 7 at a predetermined angle so that it can be moved away from the drive roller 2, if necessary. The press roller 5 is biased against the drive roller 2 by a spring 8.

The paper feeding mechanism includes a lever 10 pivotally coupled to the hinge shaft 7 so that it is rotatable around the hinge shaft 7 like the press roller 5. A cam 12 presses against the lever 10 to pivot the press roller 5 and move the press roller 5 away from the drive roller 2. An electronic clutch 14 for rotating the cam 12 is provided, if necessary.

When the drive roller 2 of the paper feeding mechanism is rotated, the press roller 5, which is in contact with the drive roller, is also rotated. A leading portion of a piece of paper can be fed into the nip between the rollers 2 and 5 to feed the paper into the printing mechanism. As the leading portion of the paper passes through the printing mechanism, an image is printed on the paper. When the trailing portion of the paper exits from the nip between the rollers 2 and 5, an unnecessary external force is applied to the paper. This unnecessary force reduces the quality of the printed image. Thus, when the trailing portion of the paper exits from the nip between the rollers 2 and 5, the lever 10 is pressed by rotating the cam 12 to move the press roller 5 away from the drive roller 2.

To move the press roller 5 away from the drive roller 2, the conventional paper feeding mechanism illustrated in FIG. 1 requires a complex construction with such parts as the cam 12 and the electronic clutch 14. In addition, the paper feeding mechanism requires means for driving the cam 12, in addition to means for driving the drive roller shaft 3. Therefore, it is difficult to produce a product with a small size and manufacturing costs are increased. Furthermore, the reliability of the paper feeding mechanism is heavily dependent on the performance of the electronic clutch 14. Producing a reliable electronic clutch is very difficult and requires significant costs. Thus, it is difficult to ensure the reliability of the paper feeding mechanism.

Accordingly, there is a need for an image forming apparatus with an improved paper feeding mechanism which is reliable, inexpensive to manufacture, and compact in size.

SUMMARY OF THE INVENTION

An aspect of the present invention is to solve at least the above problems and/or disadvantages and to provide at least the advantages described below. Accordingly, an aspect of the present invention is to provide a paper feeding mechanism with a simple structure that occupies a smaller space than a conventional paper feeding mechanism.

Another object of the present invention is to provide a paper feeding mechanism capable of moving a drive roller and a press roller apart from each other without requiring a separate driving means.

Still another object of the present invention is to provide an image forming apparatus employing the above described paper feeding mechanism.

According to an aspect of the present invention, a paper feeding mechanism includes a drive roller rotated by a first shaft that is driven by a motor. A press roller is supported by a second shaft that is parallel to and spaced apart from the first shaft. The press roller is pressed against the drive roller and therefore driven by and rotated by the drive roller. A cam pushes the second shaft to move the press roller away from the drive roller. Clutching means transfers rotational forces from the first shaft to the cam to rotate the cam when it is necessary to move the press roller away from the drive roller.

The clutching means may include a clutch spring mounted over a bushing firmly fixed to the first shaft and the cam. One end of the clutch spring is inserted into a first groove formed at the cam, and a clutch sleeve has a second groove for receiving the other end of the clutch spring. The clutch sleeve is formed as a pipe member enclosing the clutch spring. Locking means for selectively locking and unlocking the clutch sleeve is provided. When the clutch sleeve is unlocked and rotated, the clutch spring presses the cam so that the clutch spring is rotated together with the clutch sleeve to rotate the cam.

The locking means may include a protrusion formed on the outer periphery of the clutch sleeve. A stopper is rotatably fixed to the second shaft and has a first side and a second side. The first side of the stopper blocks the protrusion on the clutch sleeve. A trigger selectively blocks the second side of the stopper to selectively prevent and allow rotation of the stopper, thereby allowing the stopper and the clutch sleeve to rotate.

The locking means may further include a spring that resiliently biases the rotated stopper so that the rotated stopper is returned to its original position.

The first shaft and the second shaft may be connected by a coil spring so that the shafts are resiliently biased towards each other.

A pair of cams may be provided with each cam located at one end of the first shaft and the drive roller being interposed between the cams.

The paper feeding mechanism may further comprise a sensor located in front of the drive roller and along the feed path of the paper to detect the passage of a trailing portion of a paper.

According to another aspect of the present invention, an image forming apparatus is provided. The image forming apparatus includes a printing mechanism for printing an image on paper and a paper feeding mechanism for feeding the paper into the printing mechanism. The paper feeding mechanism includes a drive roller rotated by a first shaft that is driven by a motor. A press roller is supported by a second shaft that is parallel to and spaced apart from the first shaft. The press roller is pressed against the drive roller and therefore driven by and rotated by the drive roller. A cam pushes the second shaft to move the press roller away from the drive roller. Clutching means transfers rotational forces from the first shaft to the cam to rotate the cam when it is necessary to move the press roller away from the drive roller.

The clutching means may include a clutch spring mounted over a bushing firmly fixed to the first shaft and the cam. One end of the clutch spring is inserted into a first groove formed at the cam, and a clutch sleeve has a second groove for receiving the other end of the clutch spring. The clutch sleeve is formed as a pipe member enclosing the clutch spring. Locking means for selectively locking and unlocking the clutch sleeve is provided. When the clutch sleeve is unlocked and rotated, the clutch spring presses the cam so that the clutch spring is rotated together with the clutch sleeve to rotate the cam.

The locking means may include a protrusion formed on the outer periphery of the clutch sleeve. A stopper is rotatably fixed to the second shaft and has a first side and a second side. The first side of the stopper blocks the protrusion on the clutch sleeve. A trigger selectively blocks the second side of the stopper to selectively prevent and allow rotation of the stopper, thereby allowing the stopper and the clutch sleeve to rotate.

The locking means may further include a spring that resiliently biases the rotated stopper so that the rotated stopper is returned to its original position.

The first shaft and the second shaft may be connected by a coil spring so that the shafts are resiliently biased towards each other.

A pair of cams may be provided with each cam located at one end of the first shaft and the drive roller being interposed between the cams.

The paper feeding mechanism may further comprise a sensor located in front of the drive roller and along the feed path of the paper to detect the passage of a trailing portion of a paper.

BRIEF DESCRIPTION OF THE DRAWINGS

The above and other objects, and features, and advantages of certain embodiments of the present invention will be more apparent from the following description taken in conjunction with the accompanying drawings, in which:

FIGS. 5 and 6 are cross-sectional views of the paper feeding mechanism of FIG. 3, in which FIG. 5 shows the state where the first shaft is adjacent to a second shaft, and FIG. 6 shows the state where the first shaft is spaced apart from the second shaft.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
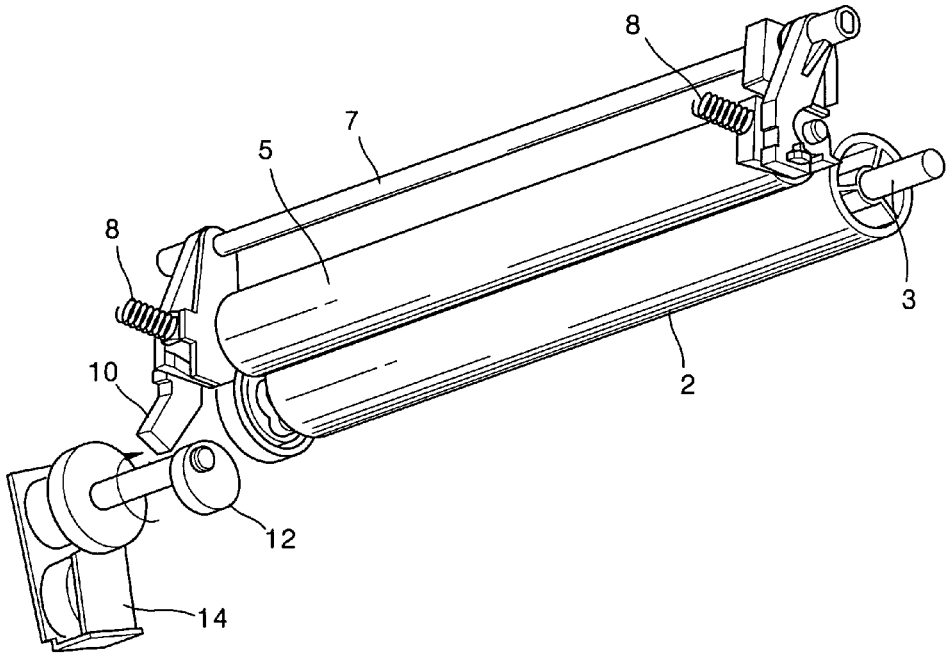
FIG. 1 (PRIOR ART)
FIG. 1 is a perspective view of one example of a conventional paper feeding mechanism employed by an image forming apparatus.
Figure 2:
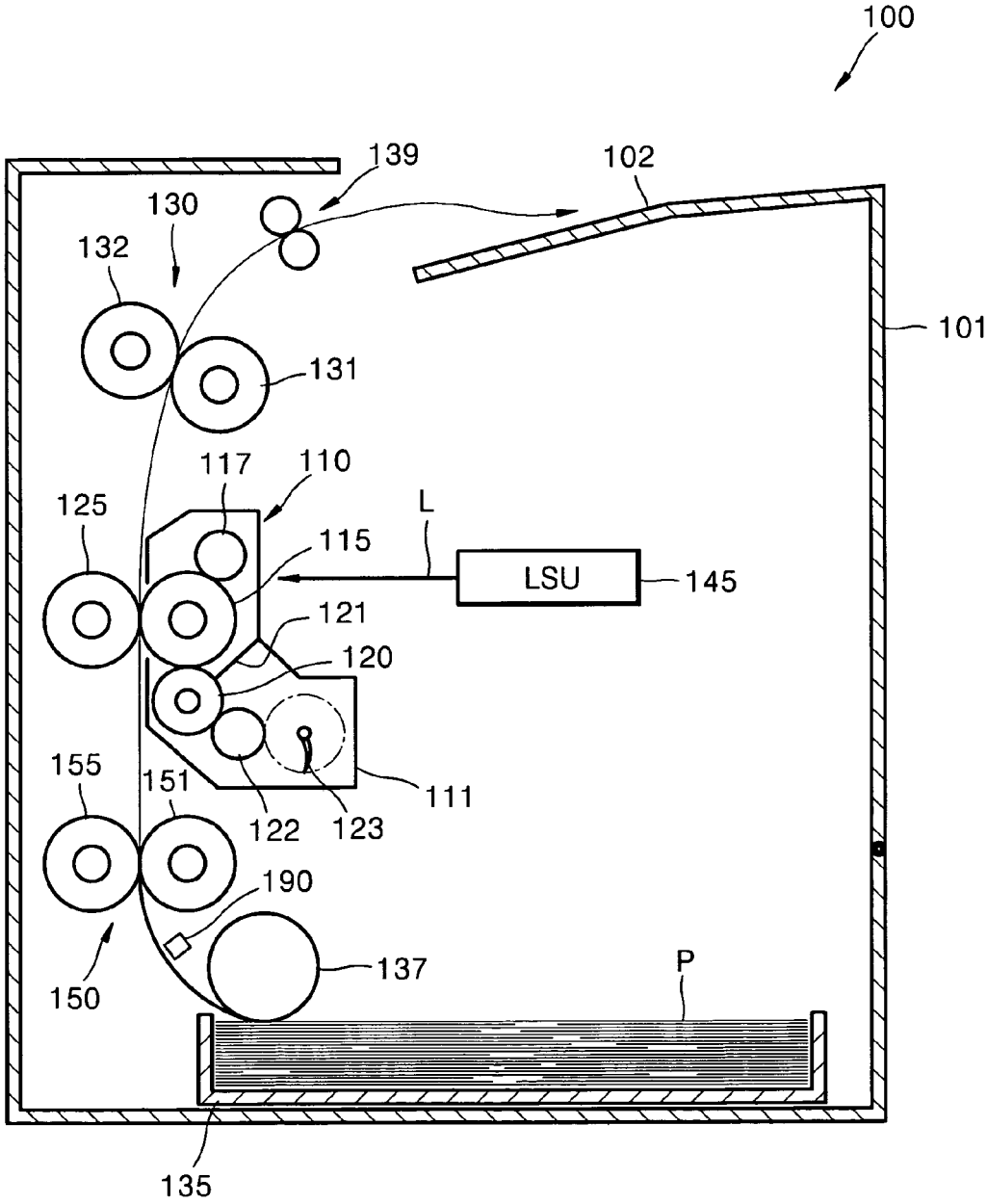
FIG. 2 is a cross-sectional view of an image forming apparatus according to an embodiment of the present invention.

Referring to FIG. 2, the image forming apparatus 100 in the illustrated embodiment is an electrophotographic image forming apparatus. An electrophotographic image forming apparatus uses a light beam to scan a photosensitive medium charged with a predetermined potential to create an electrostatic latent image. The latent image is developed with a toner of a desired color, and the developed latent image is transferred to and fixed on paper. The image forming apparatus includes a case 101, a developing unit 110 detachably mounted into the case, a transfer roller 125, and a fixing unit 130. The image forming apparatus includes a paper feeding cassette 135 with paper P stacked thereon, a paper feeding mechanism 150, and a photo-scanning unit 145.

The developing unit 110 includes a housing 111, a photosensitive drum 115 located in the housing 111 on which the latent image is formed by the light scan, a charging roller 117 for charging the photosensitive drum 115, a developing roller 120 for supplying a developer (i.e. toner) to the latent image formed on the photosensitive drum 115 to develop the latent image as a visible image, a doctor blade 121 for controlling the thickness of the toner adhered to the surface of the developing roller 120, and a supply roller 122 for supplying the toner to the developing roller 120. The housing 111 is provided with a developer accommodating space to hold toner. An agitator 123 in the developer accommodating space agitates the toner to prevent it from solidifying. The developing unit 110 is a cartridge type unit, and is thus replaced with a new one when the toner is completely consumed.

The transfer roller 125 is installed so that it contacts the photosensitive drum 115 opposite thereto. When the paper P passes between the transfer roller 125 and the photosensitive drum 115, the transfer roller 125 urges the paper P against the photosensitive drum 115 so that the visible image formed on the photosensitive drum 115 is transferred onto the paper P.

The fixing unit 130 includes a heat roller 131 and a press roller 132 located opposite to the heat roller. When the paper P with the visible image transferred thereon passes through the heat roller 131 and the press roller 132, the visible image is fixed onto the paper P by heat and pressure.

The image forming apparatus 100 includes a delivery unit 139 for ejecting the paper P, on which the desired image has been printed through the fixing unit 130, onto a delivery tray 102 located at the outside of the casing 101. The image forming apparatus 100 also includes a pick-up roller 137 for picking up, sheet by sheet, the paper P stacked on the paper feeding cassette 135 on the bottom of the case 101.

The paper feeding mechanism 150 feeds the picked-up paper P toward the developing unit 110 and keeps the paper aligned with the developing unit. The photo-scanning unit 145 scans the beam L onto an outer periphery of the photosensitive drum 115 to form the image to be printed.

The operation of the image forming apparatus 100 described above will now be discussed in further detail. The photosensitive drum 115 is charged to a predetermined potential by the charging roller 117. An electrostatic latent image corresponding to the image to be printed is formed on the outer periphery of the photosensitive drum 115 in response to the light beam L scanned by the photo-scanning unit 145. The toner in the housing 111 of the developing unit is supplied to the photosensitive drum 115 (that has the electrostatic latent image formed thereon) through the supply roller 122 and the developing roller 120. Thus, the visible image on the photosensitive drum 115 is created.

The uppermost piece of paper P which is stacked in the paper feeding cassette 135 is picked up by the pick-up roller 137. The paper is then fed by the paper feeding mechanism 150 through the nip between the photosensitive drum 115 and the transfer roller 125. At this time, the visible image formed on the photosensitive drum 115 is transferred to the surface of the paper P opposite to the photosensitive drum 115. The visible image transferred to the paper P is fixed on the paper P by heat and pressure when it passes through the fixing unit 130. The paper P is delivered to the tray 102 by the delivery unit 139.

Figure 3:
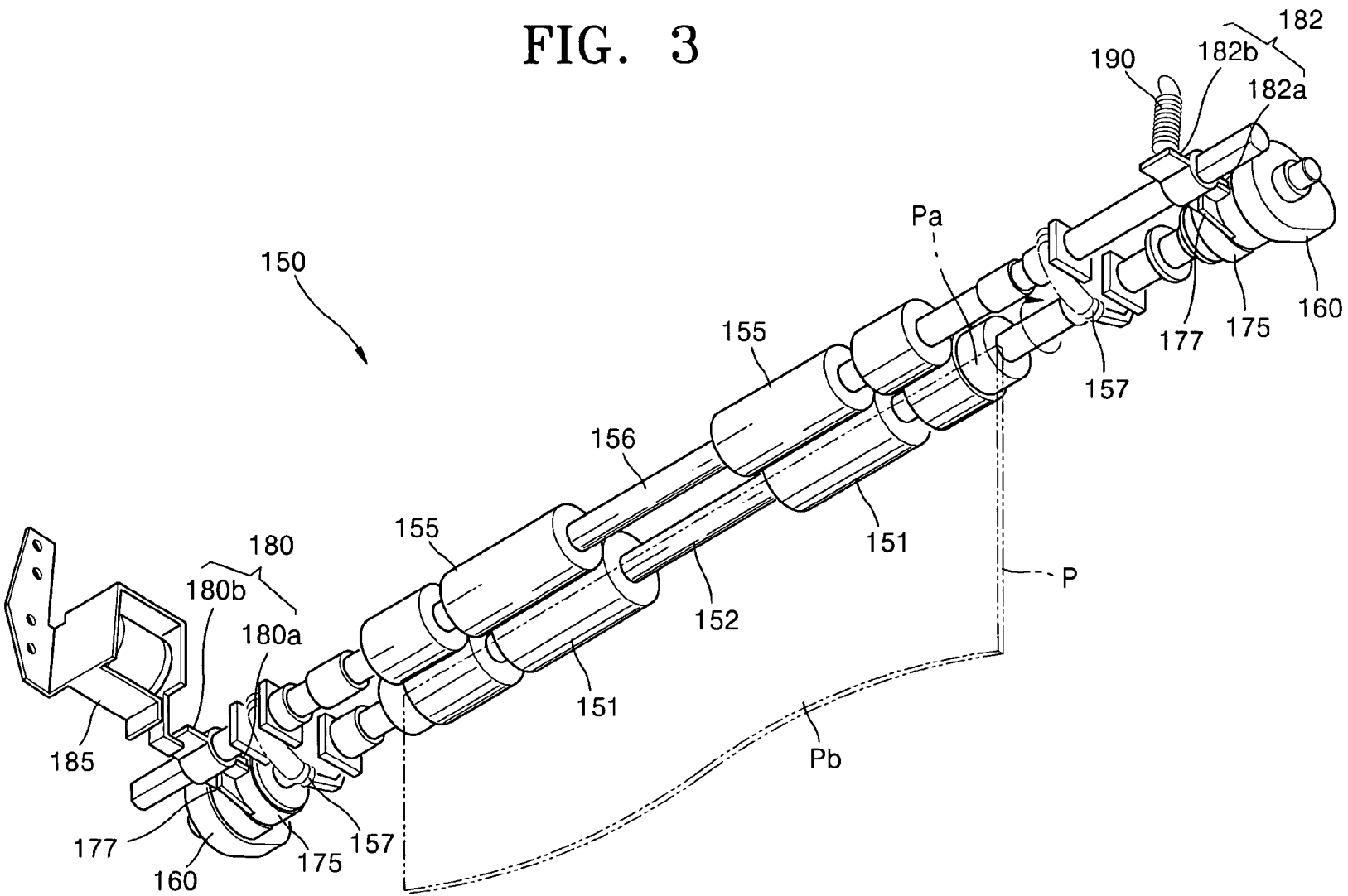
FIG. 3 is a perspective view of a paper feeding mechanism according to an embodiment of the present invention.

Referring to FIG. 3, the paper feeding mechanism 150 includes a drive roller 151 and a press roller 155 which are in contact with each other. The drive roller 151 is rotated by a first shaft 152 which is driven by a motor (not shown). The press roller 155 is supported by a second shaft 156 and is driven by the drive roller 151. The second shaft is parallel to and spaced apart from the first shaft 152. The inner diameter of the press roller 155 is larger than the outer diameter of the second shaft 156, and is placed over the second shaft 156 so that it rotates independently from the press roller 155. The front end Pa of the paper P is fed into the nip between the drive roller 151 and the press roller 155, and the paper P is transferred between the drive roller 151 and the press roller 155.

A pair of coil springs 157 are mounted at the ends of the first and second shafts 152 and 156. The coil springs resiliently bias the second shaft 156 toward the first shaft 151, and, thus, the press roller 155 is resiliently biased into contact with the drive roller 151.

The first shaft 152 includes a cam 160 for pushing the second shaft 156 to move the press roller 155 away from the drive roller 151. A pair of cams 160 are provided, one at each end of the first shaft 152. The drive roller 151 is positioned between the cams on the first shaft. The cam 160 is coaxially aligned with the first shaft 152. Since the cam 160 is coupled to the first shaft 152 via a clutching means, the cam is selectively rotated by the first shaft 152 only when the press roller 155 needs to be spaced apart from the drive roller 151.

Figure 4:
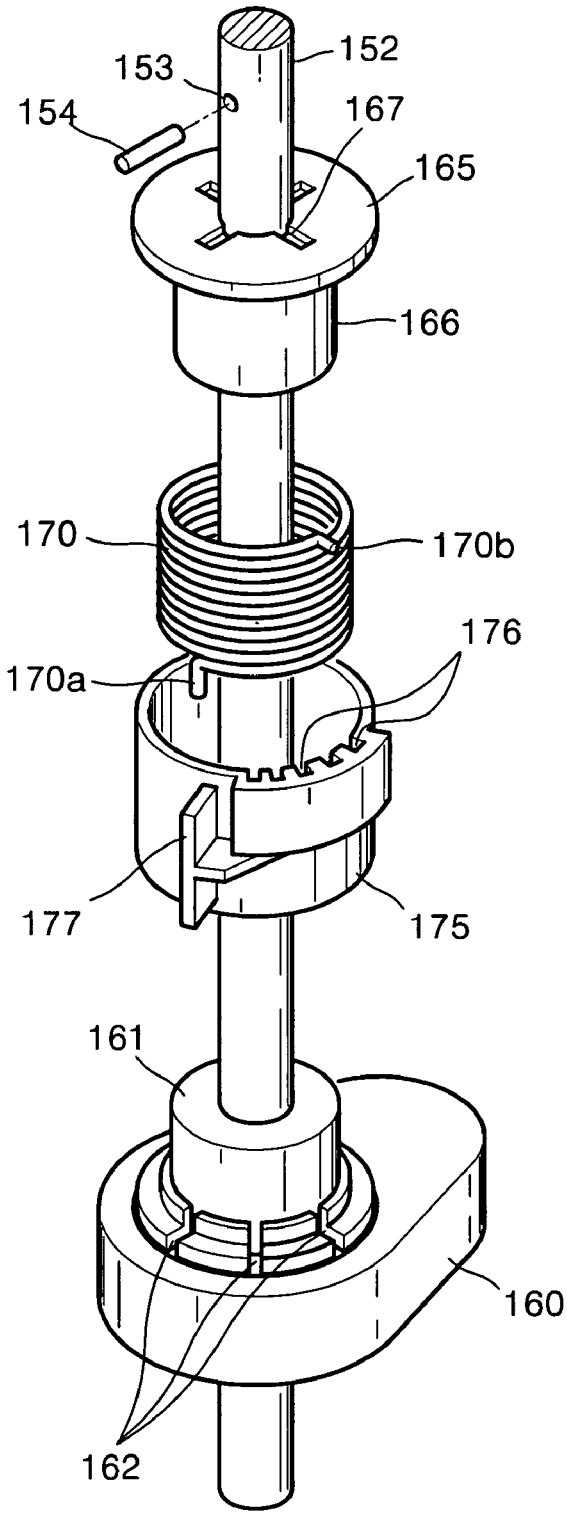
FIG. 4 is an exploded perspective view of the clutching means of the paper feeding mechanism of FIG. 3.

Referring to FIG. 4, the clutching means includes a clutch spring 170 and a clutch sleeve 175 which are mounted to the first shaft 152 in turn. The clutch spring 170 is coupled to a bushing 165 which is firmly fixed to the first shaft 152 and coupled to the cam 160 which is rotatably attached to the first shaft. Specifically, the bushing 165 has a bushing cylinder 166, and the cam 160 has a cam cylinder 161. The bushing cylinder faces the cam cylinder. The clutch spring 170 is a coil spring, and the coil diameter is slightly smaller than the diameters of the bushing cylinder 166 and the cam cylinder 161 so that the clutch spring 170 can be forcibly coupled to the bush cylinder 166 and the cam cylinder 161. As such, the clutch spring 170 exerts compression forces upon the bushing cylinder 166 and the cam cylinder 161.

A locking pin 154 having a length slightly longer than the diameter of the first shaft 152 is inserted into a pin hole 153 formed in the first shaft 152. The ends of the locking pin 154 protrude from the outer periphery of the first shaft 152 and are inserted into pin recesses 167 formed in the bushing 165. The bushing 165 is thereby fixed to the first shaft 152.

The cam 160 has a plurality of first grooves 162. The clutch sleeve 175 is a pipe member enclosing the clutch spring 170, and includes an inner periphery with a plurality of second grooves 176 and an outer periphery with a protrusion 177. One end 170*a* of the clutch spring 170 is inserted into one of the first grooves 162, and the other end 170*b* is inserted into one of the second grooves 176. The compression force applied to the bush cylinder 166 and the cam cylinder 161 is regulated by inserting the spring into the appropriate grooves.

Figure 5:
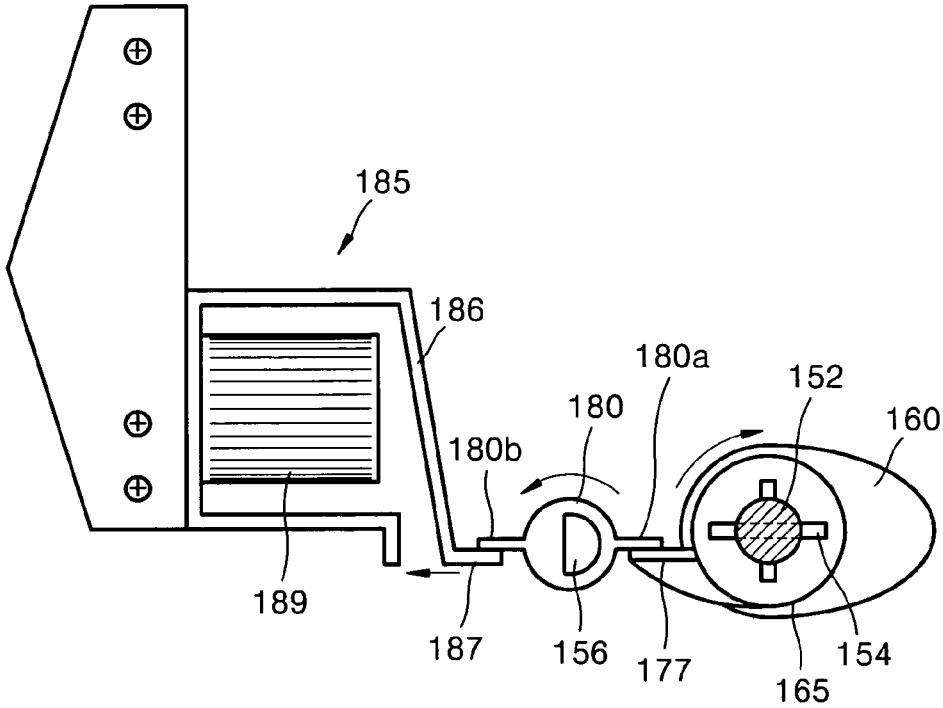
Figure 6:
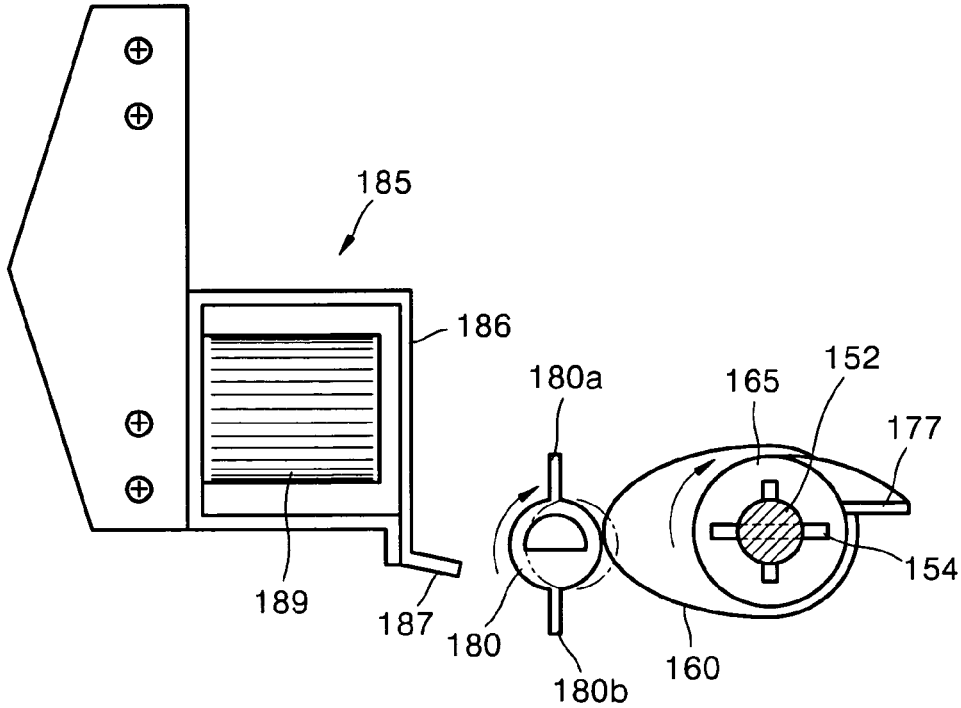

The rotational movement of the clutch sleeve 175 is locked by a locking means but can be unlocked as necessary. Referring again to FIG. 3, the locking means includes a protrusion 177 formed on the clutch sleeve 175, a first stopper 180 that is fixed to the second shaft 156 so that it rotates with the second shaft, and a trigger 185 for selectively allowing the first stopper 180 to rotate. The stopper 180 has a first side 180*a* and a second side 180*b*. The first side 180*a* of the first stopper 180 blocks the protrusion 177, and the trigger 185 blocks the second side 180*b* of the first stopper. The trigger 185 includes a solenoid 189, as shown in FIGS. 5 and 6. In the position shown in FIG. 5, a latch 187 formed at the front end of a lever 186 blocks the second side 180*b* of the first stopper. When the solenoid 189 is energized, as shown in FIG. 6, the lever 186 is pulled by the magnetic force generated by the solenoid. The second side 180*b* of the first stopper 180 is released by the latch 187 and the first stopper 180 is allowed to rotate.

A second stopper 182 is provided at the opposite end of the second shaft 156. A first side 182*a* of the second stopper 182 blocks the protrusion 177 of the clutch sleeve 175, like the first side 180*a* of the first stopper 180. The second side 182*b* of the second stopper 182 is provided with a spring 190. The stopper 182 is rotated together with the first stopper 180, and the second stopper 182 is biased towards its original position by the spring 190. When the second stopper 182 is returned to its original position by the spring 190, the first stopper 180 is correspondingly returned to its original position.

The paper feeding mechanism 150 includes, as shown in FIG. 2, a sensor 190 located in front of the drive roller 151 and the press roller 155 along a feeding path of the paper. The sensor 190 detects the passage of the trailing portion Pb (see FIG. 3) of the paper P. When the trailing portion Pb of the paper passes by the sensor 190, the trigger 185 is activated to move the press roller 155 away from the drive roller 151 after a lapse of time calculated based on the speed of the paper and the distance from the sensor 190 to the rollers 151 and 155.

The operation of the paper feeding mechanism 150 will now be described in further detail. When the leading portion Pa of the paper P passes through the nip between the drive roller 151 and the press roller 155, as shown in FIG. 5, the second side 180*b* of the first stopper 180 is blocked by the latch 187 of the trigger 185, and the protrusion 177 of the clutch sleeve 175 is blocked by the first side 180*a* of the stopper 180. Thus, even though the first shaft 152 is rotating, the clutch sleeve 175 does not rotate. In this state, the diameter of the clutch spring 170 is expanded, and the clutch spring 170 does not press against the bushing cylinder 166. Therefore, despite the rotation of the first shaft 152, the clutch spring 170 is not rotated, and the cam 160 is also not rotated.

When the trailing portion Pb of the paper passes by the sensor 190, the solenoid 189 of the trigger 185 is energized after the lapse of an appropriate amount of time which is calculated as discussed above. The magnetic force of the solenoid 189 pulls the lever 186 toward the solenoid 189, as shown in FIG. 6, and thus the first stopper 180 is unlocked from the latch 187. At this time, the protrusion 177 of the clutch sleeve 175 is also unlocked. The resilient force of the coil spring reduces the coil diameter of the clutch spring 170 and the clutch spring presses against the bushing cylinder 166. The clutch spring 170 therefore rotates together with the first shaft 152, and thus the clutch sleeve 175 and the cam 160 are rotated. As shown in FIG. 6, the second shaft 156 is pushed by the cam 160, and the press roller 155 is moved away from the drive roller 151 so that unnecessary external forces are not applied to the trailing portion Pb of the paper when the paper exits from the rollers 151 and 155.

When the cam 160 is continuously rotated together with the first shaft 152, the press roller 155 is again pressed against the drive roller 151 by the coil spring 157. As the second stopper 182 (which is fixed to the second shaft 156) is returned to the original position by the spring 190, the first stopper 180 is also returned to the original position. At this time, if the solenoid 189 of the trigger 185 is deenergized, the lever 186 is returned to the original position, and thus the latch 187 again blocks the second side 180*b* of the first stopper 180. The protrusion 177 of the clutch sleeve 175 (which rotates together with the first shaft 152) is blocked by the first side 180*a* of the first stopper 180, and the cam 160 is therefore stopped in the original position. As such, the paper feeding mechanism 150 is returned to the state shown in FIG. 5 and is ready for the next sheet of paper.

As compared to the prior art, the described apparatus for moving the press roller away from the drive roller is simple and does not utilize an electronic clutch. As such, it is more compact and improves the reliability of the paper feeding operation.

Furthermore, since it does not require a separate driving means for driving the cam, the manufacturing cost is reduced, and the power consumption during operation is decreased.

While the invention has been shown and described with reference to certain embodiments thereof, it will be understood by those skilled in the art that various changes in form and details may be made therein without departing from the spirit and scope of the invention as defined by the appended claims.

What is claimed is:

1. A paper feeding mechanism including a drive roller rotated by a first shaft driven by a motor, and a press roller supported by a second shaft that is spaced parallel to and apart from the first shaft, the press roller pressing against the drive roller and being driven by the drive roller, the paper feeding mechanism comprising:

a cam for pushing the second shaft and moving the press roller away from the drive roller; and clutching means for transferring rotating forces from the first shaft to the cam to rotate the cam and move the press roller away from the drive roller;

wherein the clutching means includes:

a bushing firmly fixed to the first shaft;

a clutch spring mounted over the bushing and having a first end and a second end, the first end of the clutch spring being inserted into a first groove formed on the cam;

a clutch sleeve enclosing the clutch spring and having a second groove for receiving the second end of the clutch spring; and locking means for selectively locking and unlocking the clutch sleeve to allow rotation of the clutch sleeve;

wherein if the clutch sleeve is unlocked and rotated, the clutch spring presses against the cam and rotates together with the clutch sleeve to rotate the cam.

2. The paper feeding mechanism of claim 1, wherein the first shaft and the second shaft are connected by a coil spring that resiliently biases the shafts towards each other.

3. The paper feeding mechanism of claim 1, wherein the locking means includes:

a protrusion formed on an outer periphery of the clutch sleeve;

a stopper rotatably fixed to the second shaft and having a first side and second side, the first side blocking the protrusion; and a trigger for selectively blocking or releasing the second side of the stopper to either prevent or allow rotation of the stopper and the clutch sleeve.

4. The paper feeding mechanism of claim 3, further including a spring for resiliently biasing the rotated stopper so that the rotated stopper is returned to its original position.

5. The paper feeding mechanism of claim 1, wherein a pair of the cams are provided with one cam located at each end of the first shaft, and the drive roller is interposed between the cams.

6. The paper feeding mechanism of claim 1, further comprising a sensor located in front of the drive roller and the press roller along a feeding path of the paper to detect the passage of a trailing portion of paper.

7. An image forming apparatus including a printing mechanism for printing an image on paper and a paper feeding mechanism for feeding paper into the printing mechanism, the paper feeding mechanism including:

drive roller rotated by a first shaft driven by a motor;

a press roller supported by a second shaft spaced parallel to and apart from the first shaft, the press roller pressing against the drive roller so that it is driven and rotated by the drive roller;

a cam for pushing the second shaft to move the press roller away from the drive roller; and clutching means for transferring rotational forces from the first shaft to the cam to rotate the cam;

wherein the clutching means includes:

a bushing firmly fixed to the first shaft;

a clutch spring mounted over the bushing and having a first end and a second end, the first end of the clutch spring being inserted into a first groove formed on the cam;

a clutch sleeve enclosing the clutch spring and having a second groove for receiving the second end of the clutch spring; and locking means for selectively locking and unlocking the clutch sleeve to allow rotation of the clutch sleeve, wherein if the clutch sleeve is unlocked and rotated, the clutch spring presses against the cam and rotates together with the clutch sleeve to rotate the cam.

8. The image forming apparatus of claim 7, wherein the first shaft and the second shaft are connected by a coil spring that resiliently biases the shafts towards each other.

9. The image forming apparatus of claim 7, wherein the locking means includes:

a protrusion formed on an outer periphery of the clutch sleeve;

a stopper rotatably fixed to the second shaft and having a first side and second side, the first side blocking the protrusion; and a trigger for selectively blocking or releasing the second side of the stopper to either prevent or allow rotation of the stopper and the clutch sleeve.

10. The image forming apparatus of claim 9, further including a spring for resiliently biasing the rotated stopper so that the rotated stopper is returned to its original position.

11. The image forming apparatus of claim 7, wherein a pair of the cams are provided with one cam located at each end of the first shaft, and the drive roller is interposed between the cams.

12. The image forming apparatus of claim 7, further comprising a sensor located in front of the drive roller and the press roller along a feeding path of the paper to detect the passage of a trailing portion of paper.

13. An image forming apparatus comprising:

a printing mechanism for printing an image on paper; and a paper feeding mechanism for feeding paper into the printing mechanism, the paper feeding mechanism including:

a drive roller mounted on a first shaft;

a press roller mounted on a second shaft, the second shaft being spaced parallel to and apart from the first shaft, the press roller pressing against the drive roller;

a cam for pushing the second shaft away from the drive roller;

a clutch to selectively transfer forces from the first shaft to the cam;

wherein the clutch comprises: a bushing with a bushing cylinder attached to the first shaft; and a clutch spring surrounding the bushing cylinder, the clutch spring having a first, smaller diameter where it exerts compression forces upon the bushing cylinder and a second, larger diameter where it does not exert compression forces upon the bushing cylinder;

a clutch sleeve enclosing the clutch spring, wherein the clutch spring has a first end and a second end, and the first end of the clutch spring is coupled to the cam and the second end of the clutch spring is coupled to the clutch sleeve; and a lock to selectively allow rotation of the clutch sleeve;

wherein the lock comprises:

a protrusion formed on an outer periphery of the clutch sleeve;

a stopper rotatably fixed to the second shaft and having a first side and second side, the first side blocking the protrusion; and a trigger to selectively release the second side of the stopper so that the stopper may rotate.

* * * * *